US008342646B2

(12) United States Patent
Mizutani

(10) Patent No.: US 8,342,646 B2
(45) Date of Patent: Jan. 1, 2013

(54) INK JET PRINT HEAD AND PRINTING METHOD AND APPARATUS USING THE SAME

(75) Inventor: Michinari Mizutani, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 450 days.

(21) Appl. No.: 12/635,251

(22) Filed: Dec. 10, 2009

(65) Prior Publication Data

US 2010/0149258 A1 Jun. 17, 2010

(30) Foreign Application Priority Data

Dec. 17, 2008 (JP) ..... 2008-321081

(51) Int. Cl.
*B41J 2/21* (2006.01)

(52) U.S. Cl. ..... 347/43; 347/40; 347/49

(58) Field of Classification Search ..... 347/15, 347/16, 20, 37, 40–43, 45
See application file for complete search history.

(56) References Cited

U.S. PATENT DOCUMENTS 6,273,550 B1 * 8/2001 Brown ..... 347/43
6,755,510 B2 6/2004 Murakami et al.
6,789,877 B2 9/2004 Murakami et al.
6,874,860 B2 * 4/2005 Lahut et al. ..... 347/13
6,964,467 B2 11/2005 Kaneko et al.
7,350,902 B2 * 4/2008 Dietl et al. ..... 347/43
7,452,056 B2 11/2008 Mizutani et al.
2008/0136872 A1 6/2008 Tsuchii et al.

FOREIGN PATENT DOCUMENTS

JP 2001-171119 6/2001
JP 2003-145775 5/2003

* cited by examiner

*Primary Examiner* — Thinh Nguyen
(74) *Attorney, Agent, or Firm* — Fitzpatrick, Cella, Harper & Scinto

(57) ABSTRACT

The present invention relates to measures for preventing end deviation that may occur during high-duty printing such as one-pass printing, and in particular, to measures for preventing density unevenness (white stripes) in the case of ink with a low lightness such as black ink. According to the present invention, the amount of black ink ejected through the corresponding ejection ports is set to be larger than that of color ink ejected through the corresponding ejection ports. Two black ink ejection chips each having at least one black ink ejection port row are arranged on the respective sides of a color ink ejection chip.

18 Claims, 9 Drawing Sheets

INK JET PRINT HEAD AND PRINTING METHOD AND APPARATUS USING THE SAME

BACKGROUND OF THE INVENTION

1. Field of the Invention

The present invention relates to an ink jet print head having ejection ports through which ink is ejected, and a printing method and apparatus using the ink jet print head.

2. Description of the Related Art

For a printing apparatus forming images on printing media, particularly an ink jet printing apparatus, an important subject is to increase the speed of color printing on plain papers or the like and to improve the quality of images.

For the ink jet printing apparatus, common techniques for increasing the print speed include, besides an increase in the length of an ink jet print head, an increase in the printing (or driving) frequency of the print head and the use of bidirectional printing. Compared to unidirectional printing, the bidirectional printing temporally disperses energy required to achieve the same throughput. The bidirectional printing is thus effective means in terms of costs of total system.

In the bidirectional printing method, depending on the configuration of the ink jet print head, the order in which each of color inks are ejected may vary between the forward movement and backward movement of the print head in a main scanning direction. This may result in uneven color density shaped like bands. To solve this fundamental problem, for example, Japanese Patent Laid-Open No. 2001-171119 proposes an ink jet print head in which rows of ejection ports (also referred to as "nozzles") are symmetrically arranged in the main scanning direction.

In the ink jet printing apparatus, a carriage holding the ink jet print head is moved at a high speed in the main scanning direction. In connection with this, if a print image with a high duty, for example, a solid image, is printed, ink droplets ejected through the ejection ports positioned at the respective opposite ends of the ejection port rows in the print head are drawn toward the center of the ejection port rows. Such a phenomenon is also called end deviation and known to be caused as follows.

That is, when ink droplets are ejected toward a print medium through the ejection ports in the ink jet print head, air present around the ink droplets moves in conjunction with the motion of the ink droplets. Thus, the atmospheric pressure in the vicinity of the ejection port rows formed in the ink jet print head tends to decrease compared to that surrounding the ink jet print head. As a result, the surrounding air flows into a decreased pressure area in which the ink droplets are ejected, thereby generating an air flow (such an air flow is hereinafter referred to as a "self air flow").

The self air flow generated in the vicinity of the ejection port rows is caused by the speed at which the print head moves in the main scanning direction (carriage scanning speed), the print density (print duty) in a predetermined area such as one print scanning area, the distance (head-paper distance) between the print medium and the print head, and the like. That is, the generation of the self air flow relates significantly to printing conditions for the ejection port rows in the ink jet print head.

When a serial scan ink jet printing apparatus is used to form an image while repeating a main scan and a sub-scan under printing conditions that may cause the self air flow, the following problem may occur. A stripe-like uneven density (white stripe) to which no ink is applied may be formed in the joining portion between print scan areas.

Japanese Patent Laid-Open No. 2003-145775 is proposed to reduce possible such white stripes. In this patent document, the arrangement interval (nozzle pitch) of ejection ports included in ejection port groups positioned at the respective opposite ends in the arrangement direction of print elements is set to be larger than that of ejection ports included in an ejection port group positioned in a central area in the arrangement direction. This serves to reduce possible white stripes.

Recently, in the field of ink jet printing apparatuses, there has been a demand to output images of high quality such as a photograph. In order to meet this demand, the ink jet print head tends to provide smaller droplets and have more densely arranged ejection ports as well as a larger length. Printing apparatuses in which such an ink jet print head is mounted tend to allow the print head to perform scanning at a higher speed and to drive at a higher frequency.

In this situation, the occurrence degree of white stripes has been increasing; the white stripes are associated with the end deviation that may occur during high-duty printing such as one-pass printing. Thus, measures for alleviating such an undesirable condition are required. In particular, black ink or the like which has a lower lightness may involve more noticeable uneven density (while stripes) than that of color ink, resulting in a more serious problem.

Thus, an object of the present invention is to use a method totally different from the conventional one to solve the problem resulting from the end deviation in the case of ink with a lower lightness as described above and provide an ink jet print head capable of forming images of high quality at a high speed. Another object of the present invention is to provide a printing method and apparatus using the ink jet print head.

SUMMARY OF THE INVENTION

The present invention is based on the following characteristic relationship between the print duty of ink and the amount of end deviation examined by the present inventor. (1) A high print duty generally tends to increase the amount of end deviation. However, if an ejection amount of ink is increased more than a certain amount even with a high print duty, the impact of a self air flow tends to be reduced and thus the amount of end deviation tends to be decreased. That is, if the same amount of ink droplets is ejected, ejection of larger droplets at a lower density reduces the print duty per unit time compared to ejection of smaller droplets at a higher density. This makes the printing unlikely to be affected by the self air flow. (2) If adjacent ejection port rows have respectively high print duties, when the distance between the adjacent ejection port rows is increased more than a certain amount, the impact of the self air flow and thus the amount of end deviation tend to be decreased. This is because although reduced pressure areas are generated near the respective ejection port rows, the reduced pressure areas are prevented from being affected by each other if the distance between the adjacent ejection port rows is long.

Moreover, as a result of dedicated examinations, the present inventor has gained new knowledge that a combination of the above-described two relationships (1) and (2) relating to a reduction in self air flow enables a reduction in the impact of end deviation through the interaction thereof.

In order to accomplish the above-described object, the present inventors examined methods for reducing the self airflow. The present inventors have thus found an epoch-making solution that solved the above-described problems based on the size of droplets of black ink with a low lightness and the arrangement of ejection ports.

That is, an ink jet print head according to the present invention includes a black ink ejection chip having a plurality of black ink ejection port rows and a color ink ejection chip having a plurality of color ink ejection port rows, wherein each of the black ink ejection ports has a larger ejection amount than each of the color ink ejection ports, the plurality of black ink ejection port rows are divided into two groups for a first black ink ejection chip and a second black ink ejection chip, and the two black ink ejection chips are symmetrically arranged on respective opposite sides of the color ink ejection chip.

Furthermore, in the ink jet print head according to the present invention, the black ink ejection port rows of each of the first and second black ink ejection chips may be arranged on respective opposite sides of a common ink supply port through which ink is supplied to each of the black ink ejection ports in the black ink ejection port rows.

Moreover, in the ink jet print head according to the present invention in which the black ink ejection port rows are arranged on the respective opposite sides with respect to the common ink supply port in each black ink ejection chip, one of the black ink ejection port rows in each of the first and second black ink ejection chips may be selected and driven.

According to the present invention, the ejection amount of each of the ejection ports for black ink is larger than that of each of the ejection ports for color ink. This enables a reduction in ejection duty per unit time and thus in the impact of the self air flow. Moreover, the black ink ejection chips are arranged on the respective sides of and symmetrically with respect to the color ink ejection chip. The distance between the ejection port rows is thus increased. This precludes self air flows generated near the respective black ink ejection port rows in each of the black ink ejection chips from affecting each other. Thus, end deviation caused by the self air flow can be prevented, enabling white stripes in printed images to be eliminated. Therefore, the image quality can be drastically improved.

Further features of the present invention will become apparent from the following description of exemplary embodiments (with reference to the attached drawings).

BRIEF DESCRIPTION OF THE DRAWINGS

FIGS. 1A and 1B are bottom views of an ink jet print head according to the present invention installed in an ink jet printing apparatus, as seen from the side of a print medium, the views schematically showing the arrangement of ejection chips, wherein FIG. 1A shows an ink jet print head in which a black ink ejection chip is formed to be longer than a color ink ejection chip, and FIG. 1B shows an ink jet print head in which the ejection chips have the same length;

FIGS. 2A to 2C are schematic diagrams of the ink jet print head in FIG. 1B, showing an example of arrangement of ejection ports and ejection port rows for each ink in a color ink ejection chip and a first black ink ejection chip and a second black ink ejection chip, wherein FIG. 2A shows a first embodiment of the ink jet print head according to the present invention, FIG. 2B shows a second embodiment of the ink jet print head according to the present invention, and FIG. 2C shows a third embodiment of the ink jet print head according to the present invention;

FIGS. 3A to 3C are schematic diagrams of the ink jet print head in FIG. 1B, showing an example of arrangement of ejection ports and ejection port rows for each ink in a color ink ejection chip and a first black ink ejection chip and a second black ink ejection chip, wherein FIG. 3A shows a fourth embodiment of the ink jet print head according to the present invention, FIG. 3B shows a fifth embodiment of the ink jet print head according to the present invention, and FIG. 3C shows a sixth embodiment of the ink jet print head according to the present invention;

FIGS. 9A to 9C are diagrams showing the relationship between the amount of end deviation and the arrangement of dots, wherein FIG. 9A shows that the amount of end deviation is 0, FIG. 9B shows that the amount of end deviation is 10 μm, and FIG. 9C shows that the amount of end deviation is 14 μm.

DESCRIPTION OF THE EMBODIMENTS

Ink

First, ink used for an ink jet print head according to the present invention will be described.

Black ink used in the present invention uses a pigment composed of carbon black as a color material. The surface of the pigment is subjected to surface treatment such as carboxylation so as to enable the pigment to be dispersed in the ink. Furthermore, in order to inhibit liquid from being evaporated from the ink, polyalcohol such as glycerin is preferably added to the ink as a humectant. Moreover, the pigment ink is used to print characters. Thus, it is important to prevent the edges of black ink dots formed on plain paper from being degraded. In order to adjust the permeability of ink to the extent that the edges are not degraded, a surfactant containing acethylene glycohol may be added to the ink. Furthermore, in order to enhance the binding force between the pigment and a print medium, polymer may be added to the ink as a binder.

Cyan ink, magenta ink, and yellow ink are used as color ink in the present invention. A cyan dye, a magenta dye, and a yellow dye are used as the ink. A humectant, a surfactant, and an additive are preferably added to the ink. Furthermore, instead of the dyes, pigments may be used as color materials.

The surfactant is desirably adjusted such that the cyan ink, the magenta ink, and the yellow ink offer substantially the same surface tension. By setting the same permeability for all the ink types to plain paper, bleeding between areas on paper printed by the respective types of ink can be inhibited. Furthermore, the characteristics of the ink other than those described above, such as the permeability and viscosity thereof, are adjusted to conform with all of the cyan ink, magenta ink, and yellow ink.

(Configuration of the Ink Jet Print Head)

Now, the basic configuration of the ink jet print head according to the present invention will be described mainly with reference to FIGS. 1A, 1B, and 2A.

Figure 1A:
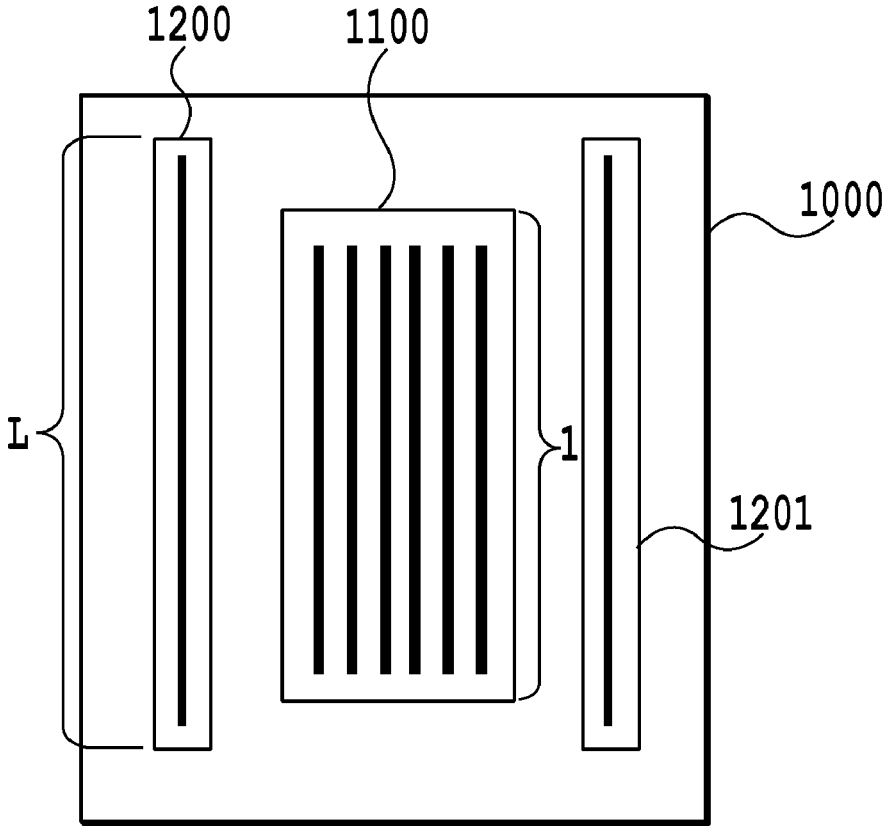
Figure 1B:
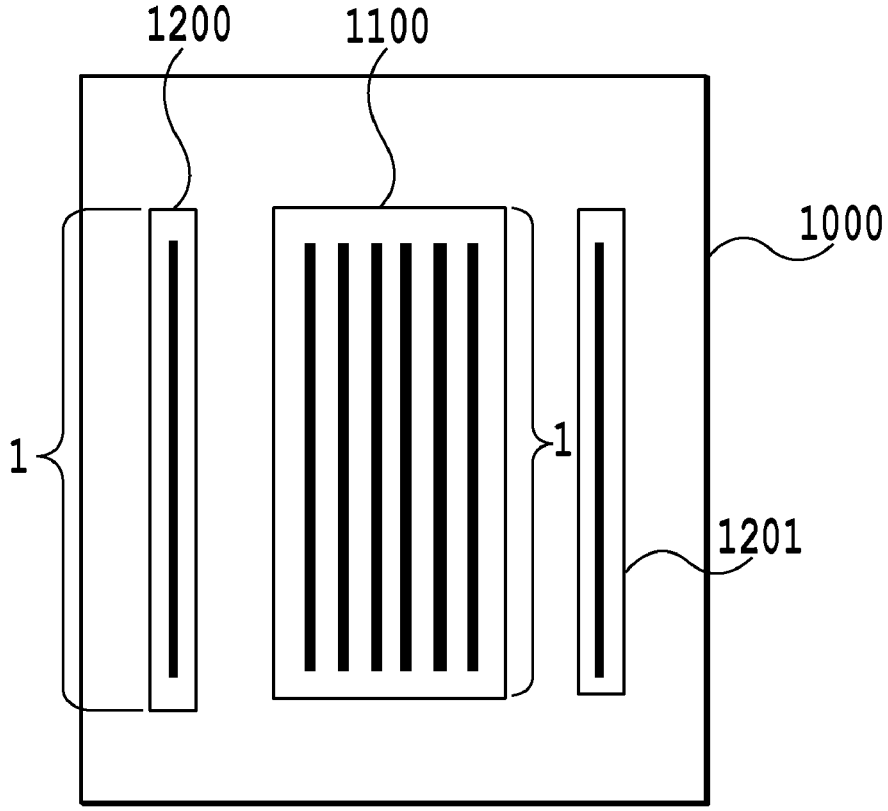

FIGS. 1A and 1B are bottom views of an ink jet print head according to the present invention installed in an ink jet printing apparatus, as seen from the side of a print medium, the views schematically showing the arrangement of ejection chips.

As shown in FIGS. 1A and 1B, the ink jet print head according to the present invention includes a color ink ejection chip 1100 and a first black ink ejection chip 1200 and a second black ink ejection chip 1201 all of which are connected to a base material 1000. In each of the first and second black ink ejection chips 1200 and 1201, a plurality of ejection ports are arranged in a line to form a black ink ejection port row. The length (the arrangement range of the ejection ports) of the ejection port row in each of the first and second black ink ejection chips 1200 and 1201 shown in FIG. 1A is set to be larger than that of each ejection port row in the color ink ejection chip 1100 in the direction in which the print medium is conveyed (sub-scanning direction). That is, when the length of the ejection port row in each of the first and second black ink ejection chips is defined as L and the length of each ejection port row in the color ink ejection chip 1100 is defined as l, L>l in the ink jet print head shown in FIG. 1A. In this configuration, when the print medium is printed using only black ink, print speed can be increased. Furthermore, the length L of the ejection port row in each of the first and second black ink ejection chips 1200 and 1201 shown in FIG. 1B is the same as the length l of each ejection port row in the color ink ejection chip 1100.

Furthermore, as shown in FIGS. 1A and 1B, the color ink ejection chip 1100 and the first and second black ink ejection chips 1200 and 1201 are arranged parallel to each other in the print medium direction. More specifically, the first and second black ink ejection chips 1200 and 1201 are arranged on the respective sides of the color ink ejection chip 1100.

Figure 2A:
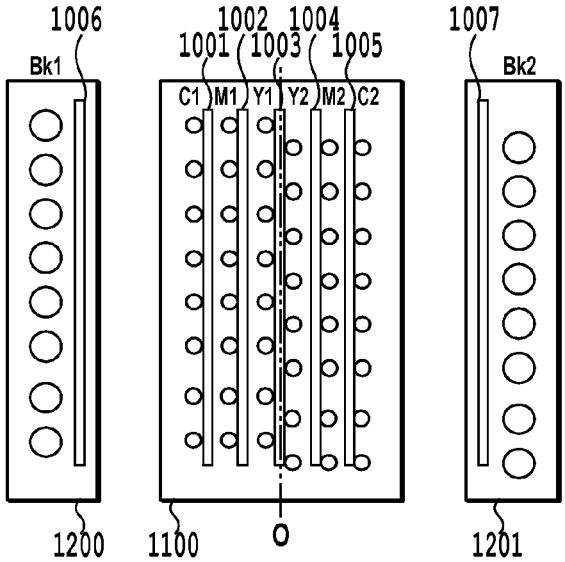

FIG. 2A is a schematic diagram of the ink jet print head, showing an example of arrangement of the ejection ports and ejection port rows for each color ink in the color ink ejection chip 1100 and the first and second black ink ejection chips 1200 and 1201.

A plurality of ejection ports and ink supply paths communicating with the ejection ports are formed in the color ink ejection chip 1100 and the first and second black ink ejection chips 1200 and 1201 for cyan, magenta, yellow, and black, respectively. The ejection chips 1100, 1200, and 1201 also include common liquid chambers 1001 to 1007 through which the corresponding ink is supplied to the respective supply path, and a common ink supply port. The ejection chips 1100, 1200, and 1201 further include ejection energy generation elements (heaters) generating ejection energy (thermal energy) allowing ink to be ejected through the ejection ports.

In the first and second black ink ejection chips 1200 and 1201 shown in FIG. 2A, ejection port rows Bk1 and Bk2 through which black ink is ejected are arranged along common liquid chambers 1006 and 1007, respectively. The ejection port rows Bk1 and Bk2 formed in the first and second black ink ejection chips 1200 and 1201, respectively, and through which black ink is ejected are arranged symmetrically, in the main scanning direction, with respect to the center line O of the color ink ejection chip 1100.

Figure 3A:
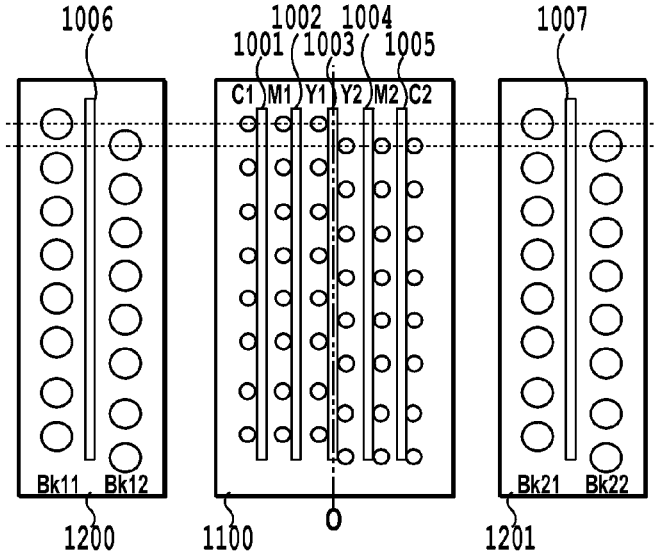

In the ink jet print head shown in FIG. 2A, one ejection port row is located in each of the black ink ejection chips. However, the present invention is not limited to this aspect. A plurality of ejection port rows may be arranged in the ejection chip. For example, as shown in FIG. 3A, two ejection port rows Bk11 and Bk12 may be arranged in the first black ink ejection chip 1200, and two ejection port rows Bk21 and Bk22 may be arranged in the second black ink ejection chip 1201. In this case, in the first black ink ejection chip 1200, the ejection port rows Bk11 and Bk12 are arranged along and on the respective sides of the common liquid chamber 1006. Furthermore, the ejection port rows Bk11 and Bk22 are arranged symmetrically, in the main scanning direction, with respect to the center line O of the color ink ejection chip 1100. The ejection port rows Bk12 and Bk21 are arranged symmetrically, in the main scanning direction, with respect to the center line O of the color ink ejection chip 1100.

Two color ejection port rows through which each ink of cyan, magenta, and yellow is ejected are arranged in the color ink ejection chip 1100; a total of six ejection port rows are arranged in the color ink ejection chip 1100. The ejection port rows C1 and C2 through which cyan ink is ejected are arranged symmetrically, in the main scanning direction, with respect to the center line O of the color ink ejection chip 1100. The ejection port rows M1 and M2 through which magenta ink is ejected are arranged symmetrically, in the main scanning direction, with respect to the center line O of the color ink ejection chip 1100. The ejection port rows C1, C2, M1, and M2 are arranged along the common liquid chambers 1001, 1005, 1002, and 1004, respectively. Furthermore, the two ejection port rows Y1 and Y2, through which yellow ink is ejected, are arranged in proximity to each other and arranged along and on the respective sides of the single common chamber 1003. The common liquid chamber 1003 for yellow ink extends on the center line O of the color ink ejection chip 1100 in the sub-scanning direction.

Now, the configuration of the black ink ejection chips 1200 and 1201 and color ink ejection chip 1100 shown in FIG. 2A will be more specifically described.

The black ink ejection chips 1200 and 1201 are the same and are made of silicon. One groove is formed in each of the black ink ejection chips 1200 and 1201. The plurality of ejection ports through which the corresponding ink is ejected and other components are formed on one side of the groove. Each groove is provided with the plurality of ejection ports, the ink supply paths communicating with the respective ejection ports, heaters each formed in a part of the corresponding ink supply path, and the common liquid chamber 1006 or 1007 communicating with all the ink supply paths. The common liquid chambers 1006 and 1007, formed in the ejection chips 1200 and 1201, respectively, extend linearly in the sub-scanning direction in association with the plurality of ejection ports.

Furthermore, in each of the ejection chips 1200 and 1201, a driving circuit (not shown in the drawings) is provided around the groove to drive the heaters. The heaters and the driving circuit are manufactured by a process similar to a film-forming process of a semiconductor. The ink supply paths and the ejection ports are formed of resin. Moreover, the ink supply port is formed in the back surface of the silicon ejection chips to guide ink to the corresponding one of the common liquid chambers 1006 and 1007.

The color ink ejection chip 1100 is made of silicon and is provided with five grooves. The plurality of ejection ports through, which the corresponding ink is ejected, and other components are formed along each of the grooves. As with the black ink ejection chips, each groove is provided with the plurality of ejection ports, the ink supply paths, heaters, and the corresponding one of the common liquid chamber 1001 to 1005. Also, a driving circuit and the ink supply port are provided in and around each groove.

The five grooves formed in the color ink ejection chip 1100 are generally represented by the common liquid chambers 1001 to 1005 extending in the sub-scanning direction. In the color ink ejection chip 1100, the five grooves (common liquid chambers), that is, the first groove 1001, the second groove 1002, the third groove 1003, the fourth groove 1004, and the fifth groove 1005, are arranged in this order from the left of FIG. 2A in the main scanning direction. In the embodiment shown in FIG. 2A, cyan ink is supplied to the first groove 1001 and the fifth groove 1005, magenta ink is supplied to the second groove 1002 and the fourth groove 1004, and yellow ink is supplied to the third groove 1003.

The cyan ink ejection port row C1, composed of 64n (n is an integer of at least one; for example, n=4) ejection ports, is formed in the first groove 1001. The magenta ink ejection port row M1, composed of 64n ejection ports, is formed in the second groove 1002. Furthermore, the yellow ink ejection port row Y1, composed of 64n ejection ports, is formed on the second groove 1002 side of the third groove 1003. The yellow ink ejection port row Y2, composed of 64n ejection ports, is formed on the fourth groove 1004 side of the third groove 1003. Moreover, the magenta ink ejection port row M2, composed of 64n ejection ports, is formed in the fourth groove 1004. The cyan ink ejection port row C2, composed of 64n ejection ports, is formed in the fifth groove 1005.

The ejection ports are arranged in each of the ejection port rows at a substantially constant pitch (600 dpi). Furthermore, for the two ejection port rows through which the ink in the same color is ejected, the ejection ports in one of the ejection port rows are staggered with respect to the ejection ports in the other ejection port row in the sub-scanning direction by a distance (1,200 dpi) equal to half of the pitch between the ejection ports. Thus, images can be formed at a print density of 1,200 dpi using two corresponding ejection port rows to each color ink.

Figure 5:
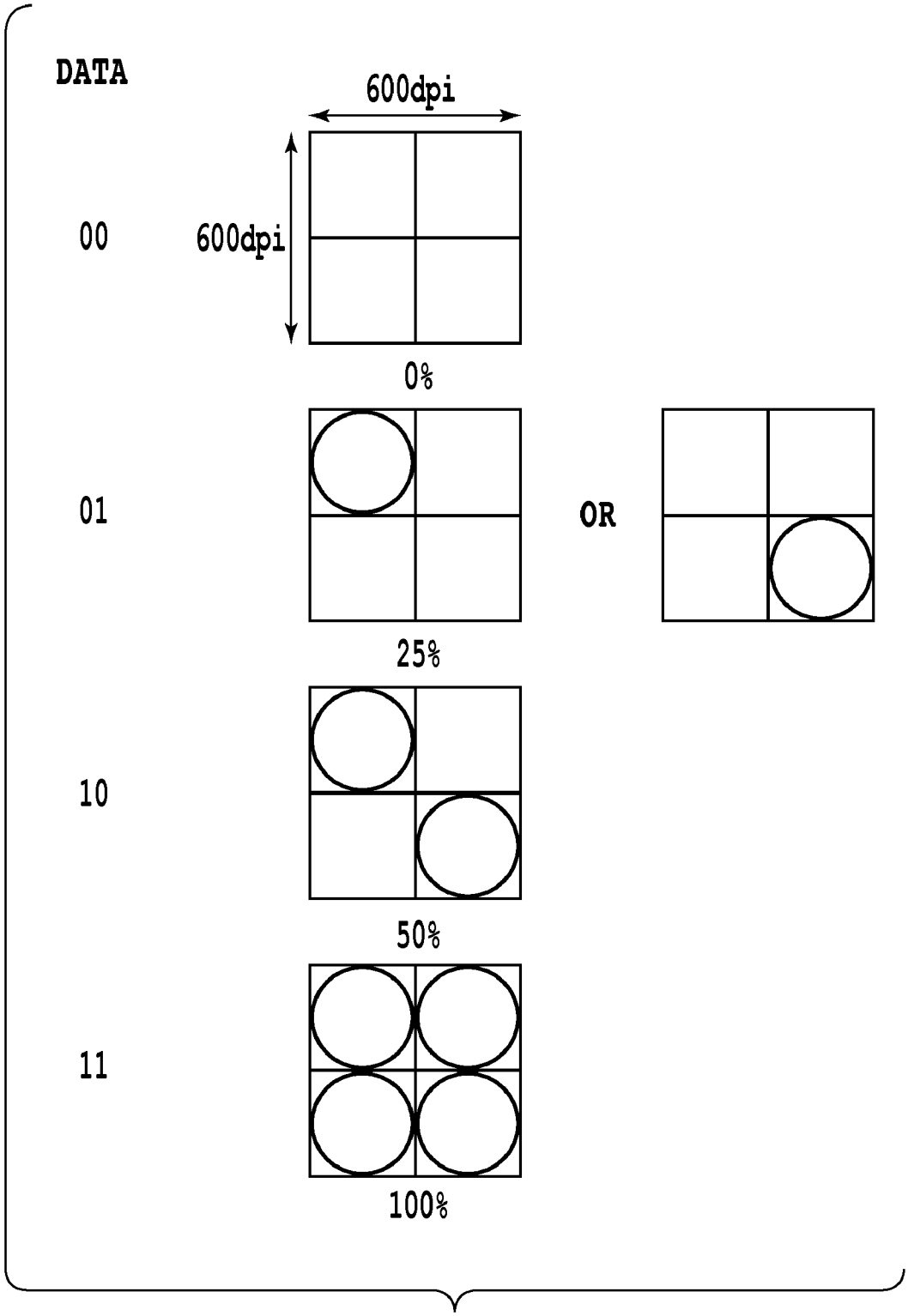
FIG. 5 is a diagram showing an example of the arrangement of dots forming one pixel using the ink jet print head shown in FIG. 1A or 1B.

FIG. 5 shows an example of the arrangement of dots used to form one pixel using the ink jet print head shown in FIG. 1. Here, one pixel is formed of four dots. Thus, one pixel is displayed by up to four dots. Specifically, when in image processing, data is processed in units of 600 dpi, multivalued information, in the present embodiment, 4-valued information is generated for one pixel. Based on the multivalue information, the printing apparatus sets the number of dots to be printed using a plurality of ejection ports corresponding to the pixel. In the embodiment shown in FIG. 5, one pixel of 600 dpi is composed of 2 dots×2 dots. That is, for one pixel, an image is formed by using four dots. This is only an example, and the number of dots forming one pixel may vary depending on the characteristics of the printing apparatus or the print head.

Moreover, in data processing for forming an image, in order to allow bidirectional printing to be achieved, data is distributed to the two ejection port rows for the each color ink such that data are generated uniformly. Specifically, print buffers corresponding to the respective ejection port rows are provided. Then, processing is carried out to store above-described 4-valued data in the corresponding print buffer. Thus, during each scan, data is read out of the print buffer corresponding to each of the ejection port rows. The data is then transferred to allow the ink to be ejected through the ejection ports in the respective ejection port row.

(Ink Jet Printing Apparatus)

Figure 6:
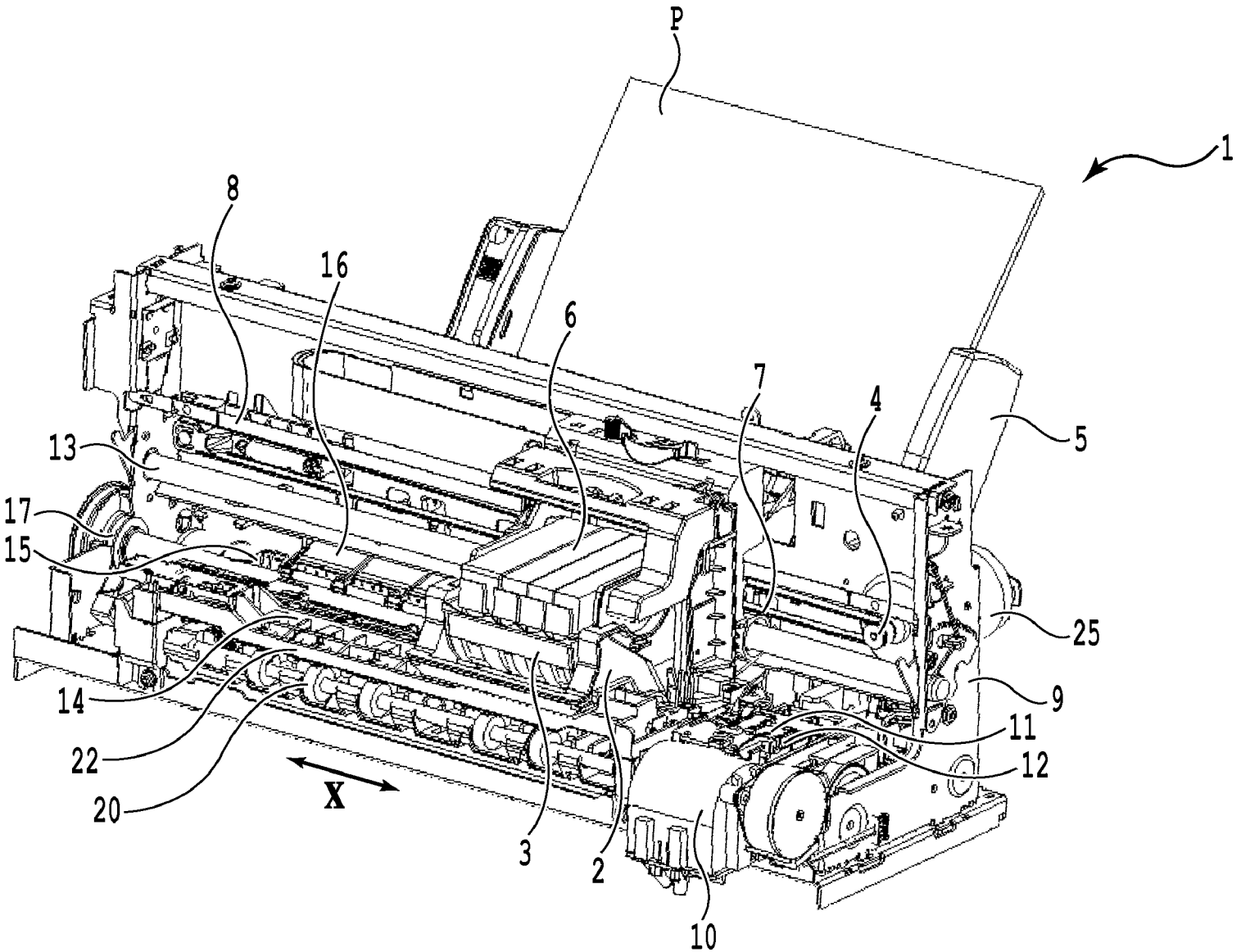
FIG. 6 is a perspective view showing the configuration of an ink jet printing apparatus in which the ink jet print head according to the present invention is mounted, with a case cover removed therefrom.

FIG. 6 is a perspective view showing the configuration of an ink jet printing apparatus 1 in which the ink jet print head according to the present invention is mounted, with a case cover removed therefrom;

As shown in FIG. 6, the ink jet printing apparatus 1 includes a carriage 2 on which an ink jet print head 3 shown in FIGS. 1A and 1B is removably mounted, and a driving mechanism moving the carriage 2 to allow the ink jet print head 3 to perform scanning. That is, the carriage 2 can be reciprocated in the direction of arrow X (main scanning direction) in FIG. 6 by transmitting the driving force of a carriage motor 25 serving as a driving source, to the carriage 2 via a transmission mechanism 4 composed of a belt, a pulley, and the like. Ink cartridges 6 corresponding to the types of ink used in the printing apparatus 1 are removably mounted on the carriage 2. As described with reference to FIGS. 1A, 1B, and 2A, the ink jet print head uses four types of ink, black ink, cyan ink, magenta ink, and yellow ink. FIG. 6 shows four ink cartridges 6 accommodating the respective types of ink.

Ink supply paths are formed in the carriage 2 so as to feed, from any of the cartridges 6, ink to the corresponding one of the grooves (common liquid chambers) in the black ink ejection chips 1200 and 1201 and the color ink ejection chip 1100 shown in FIGS. 1A and 1B and other figures. Furthermore, the ink jet print head 3, composed of the carriage 2 and the ejection chips 1100, 1200, and 1201, is configured so as to achieve required electric connection between the carriage 2 and each of the ejection chips 1100, 1200, and 1201 through the appropriate contact between the junction surfaces of these members. Thus, the ink jet print head 3 applies a voltage pulse to the above-described heaters in response to a print signal to generate bubbles in the ink. The pressure of the bubbles then allows the ink to be ejected through the ejection ports. That is, when the voltage pulse is applied to the heaters, serving as electrothermal converters, the heaters generate thermal energy to cause film boiling in the ink. Thus, bubbles grow and contract and the pressure thereof varies. The variation in pressure is then utilized to eject the ink through the ejection ports.

The ink jet printing apparatus 1 also includes a sheet feeding mechanism 5 conveying (feeding) print paper P serving as a print medium, to feed the print paper P by a predetermined amount in response to scanning by the ink jet print head 3. The print paper P is fed into the scan area of the ink jet print head 3 by the sheet feeding mechanism. The ink head print head 3 prints images, characters, or the like on the print paper P by means of scanning. The ink jet printing apparatus 1 further includes a recovery device 10 located at one end of the moving range of the carriage 2 to carry out an ejection recovery process on the ink jet print head 3.

The ink jet printing apparatus 1 will be described in further detail. The carriage 2 is coupled to a part of a driving belt 7 included in a transmission mechanism transmitting the driving force of a carriage motor 25. The carriage 2 is guided and supported so as to be slidable along a guide shaft in the direction of arrow X. Thus, the driving force of the carriage motor 25 is transmitted to the carriage 2, which can thus reciprocate. In this case, the carriage 2 can be moved forward or backward by normal or reverse rotation of the carriage motor 25.

In FIG. 6, reference numeral 8 denotes a scale used to detect the position of the carriage 2 in the direction of arrow X. Here, the scale is a transparent PET film on which black bars are printed at a predetermined pitch. One side of the scale 8 is secured to a chassis 9. The other side of the scale 8 is supported by a leaf spring (not shown). A sensor provided on the carriage 2 optically detects the bar of the scale 8, allowing the position of the carriage 2 to be detected.

The ink jet printing apparatus 1 includes a platen (not shown) in the scan area of the ink jet print head 3 which is positioned opposite any of the ejection port rows during scanning by the print head 3. The ink in the appropriate color is ejected to the print paper P being conveyed on the platen to allow printing on the print paper P the surface of which is kept flat by the platen. Thus, an image is formed.

Figure 7:
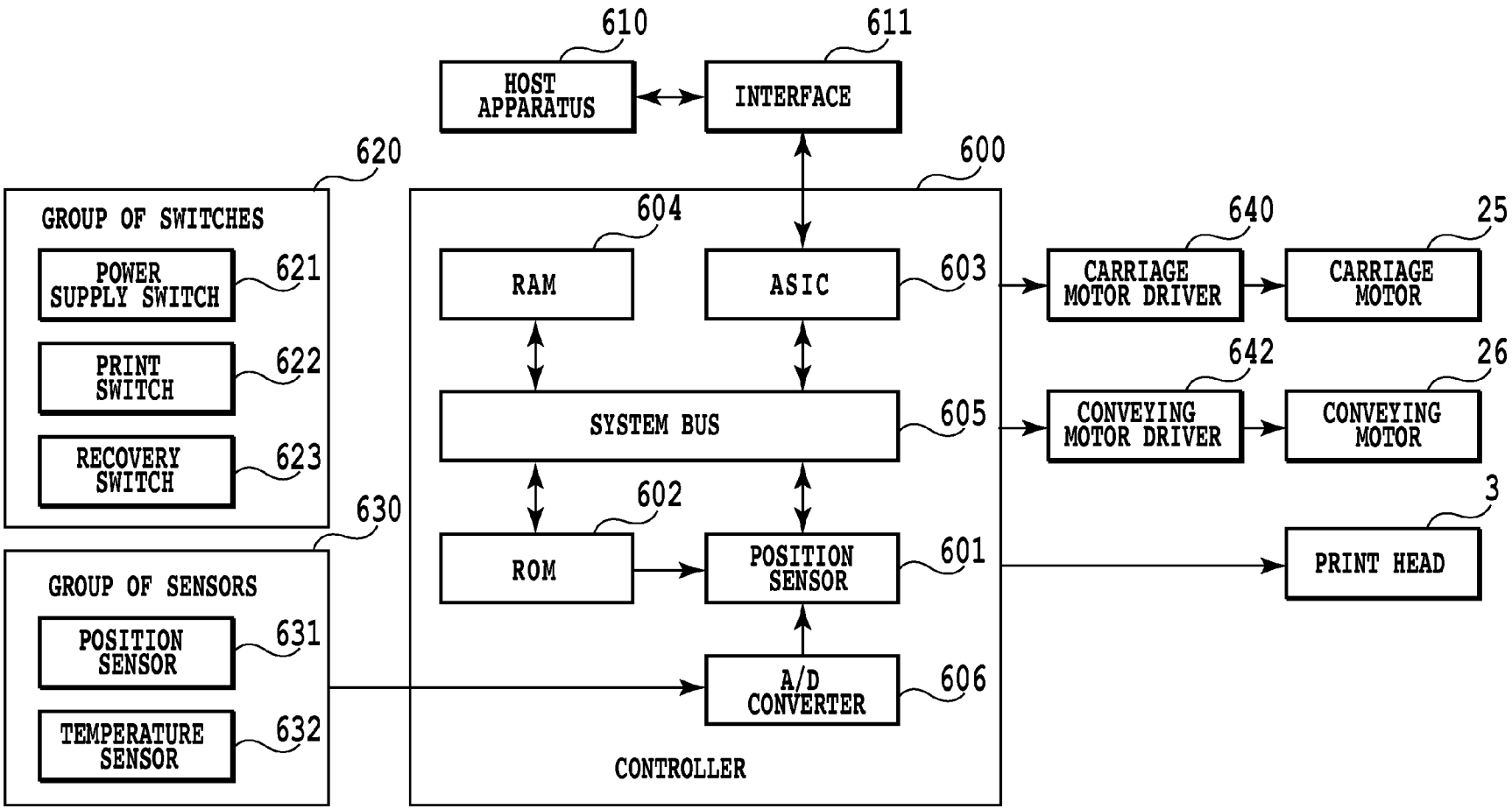
FIG. 7 is a block diagram schematically showing the configuration of a control system in the ink jet printing apparatus shown in FIG. 6.

In FIG. 6, reference numeral 14 denotes a conveying roller driven by a conveying motor 26 (see FIG. 7). Reference numeral 15 denotes a pinch roller holder brought into abutting contact with the conveying roller 14 via the print paper by a spring (not shown). Furthermore, reference numeral 17 denotes a conveying roller gear attached to one end of the conveying roller 14. Rotation of the conveying motor 26 is transmitted to the conveying roller gear 17 via an intermediate gear (not shown) to drive the conveying roller 14. Reference numeral 20 denotes a discharge roller allowing the print paper with the image formed thereon by the ink jet print head 3 to be discharged to the exterior of the apparatus. Like the conveying roller 14, the discharge roller 20 is driven by transmitting the rotation of the conveying motor 26 to the discharge roller 20. The discharge roller 20 is brought into abutting contact with a spur roller (not shown) via the print paper by the pressing force of a spring (not shown). Reference numeral 22 denotes a spur holder rotatably supporting the spur roller.

As described above, the recovery device 10, allowing the ejection performance of the ink jet print head 3 to be maintained, is disposed at a predetermined position (for example, the position corresponding to a home position) outside the range (scanning range) of reciprocation of the carriage 2 for a printing operation. The recovery device 10 includes a capping mechanism 11 capping an ejection port surface (the surface in which the ejection port rows for the respective colors are formed) of the ink jet print head 3, and a wiping mechanism 12 cleaning the ejection port surface of the print head 3. In conjunction with the capping of the ejection port surface by the capping mechanism 11, a suction mechanism (a suction pump and the like; not shown in the drawings) in the recovery device 10 forces the ink to be discharged through the ejection ports. Thus, an ejection recovery process can be carried out which includes removal of thickened ink and bubbles in the ink supply paths of the ink jet print head 3. Furthermore, during non-printing, the ejection port surface of the ink jet print head is capped to allow the print head 3 to be protected, while preventing the ink from being dried. Moreover, the wiping mechanism 12 is located near the capping mechanism 11 to wipe off ink droplets attached to the ejection port surface of the ink jet print head 3. The ejection port surface is thus cleaned. Thus, the capping mechanism 11 and the wiping mechanism 12 enable the ink jet print head 3 to be kept in a normal ejection state.

FIG. 7 is a block diagram schematically showing the configuration of a control system in the ink jet printing apparatus 1 shown in FIG. 6.

As shown in FIG. 7, a controller 600 includes a CPU 601 in the form of a microcomputer to carry out various print modes and control printing operations performed in the print modes. Furthermore, the controller 600 includes a ROM 602 storing a program corresponding to the sequence of image processing, required tables, and other fixed data. Moreover, the controller 600 includes an application specific integrated circuit (ASIC) generating control signals for control of the carriage motor 25, control of the conveying motor 26, ejection control for the ink jet print head 3, and the like in order to carry out the various print modes. Additionally, the controller 600 includes a RAM 604 with an area in which image data is expanded, a work area, and the like, and a system bus 605 connecting the CPU 601, the ASIC 603, and the RAM 604 together to allow data to be transmitted and received among these components. Moreover, the controller 600 includes an A/D converter 606 to which analog signals from a group of sensors described below are input and which supplies respective digital signals to the CPU 601.

In FIG. 7, reference numeral 610 denotes a host computer (or a reader for reading images, a digital camera, or the like) serving as a supply source for image data and transmitting and receiving image data, commands, status signals, and the like to and from the controller 600 via an interface (I/F) 611.

Reference numeral 620 denotes a group of switches allowing the operator's instruction inputs to be accepted and including a power supply switch 621, a switch 622 for giving an instruction to start printing, and a recovery switch 623 for instructing the ink jet print head 3 to start a recovery process. Reference numeral 630 denotes a group of sensors including a photo coupler 631 detecting that the ink jet print head 3 lies at the home position and combined with the scaler 8, and a temperature sensor 632 provided at an appropriate position in the printing apparatus 1 to detect the environmental temperature. Moreover, reference numeral 640 denotes a driver driving the carriage motor 25. Reference numeral 642 denotes a driver driving the conveying motor 26.

In the above-described configuration, the ink jet printing apparatus according to the present invention analyzes a command with print (image) data transferred via the interface 611, and expands the image data to be printed, into the RAM 604. An expansion area (expansion buffer) for image data is formed to have a horizontal size corresponding to the number of pixels Hp in a printable area in the main scanning direction. Furthermore, the expansion area is formed to have a vertical size corresponding to the number of pixels 64n printed in the vertical direction using the ejection port row in the ink jet print head 3 during one scan. In this manner, the expansion buffer is provided on the storage area of the RAM 604. On the other hand, the storage area (print buffer) on the RAM 604 referenced during print scan to transmit print data is formed to have a horizontal size corresponding to the number of pixels Vp in a printable area in the main scanning direction. Furthermore, the print buffer on the RAM 604 is formed to have a vertical size corresponding to the number of pixels 64n printed in the vertical direction during one print scan performed by the ink jet print head 3. In this manner, the print buffer is also provided on the storage area of the RAM 604. During the print scan performed by the ink jet print head 3, the ASIC 603 directly accesses the storage area (print buffer) of the RAM 604, while acquiring data on driving of the heaters, for each of the ejection ports in the print head 3, and then transferring the data to the driver of the print head 3.

(End Deviation)

Figure 8:
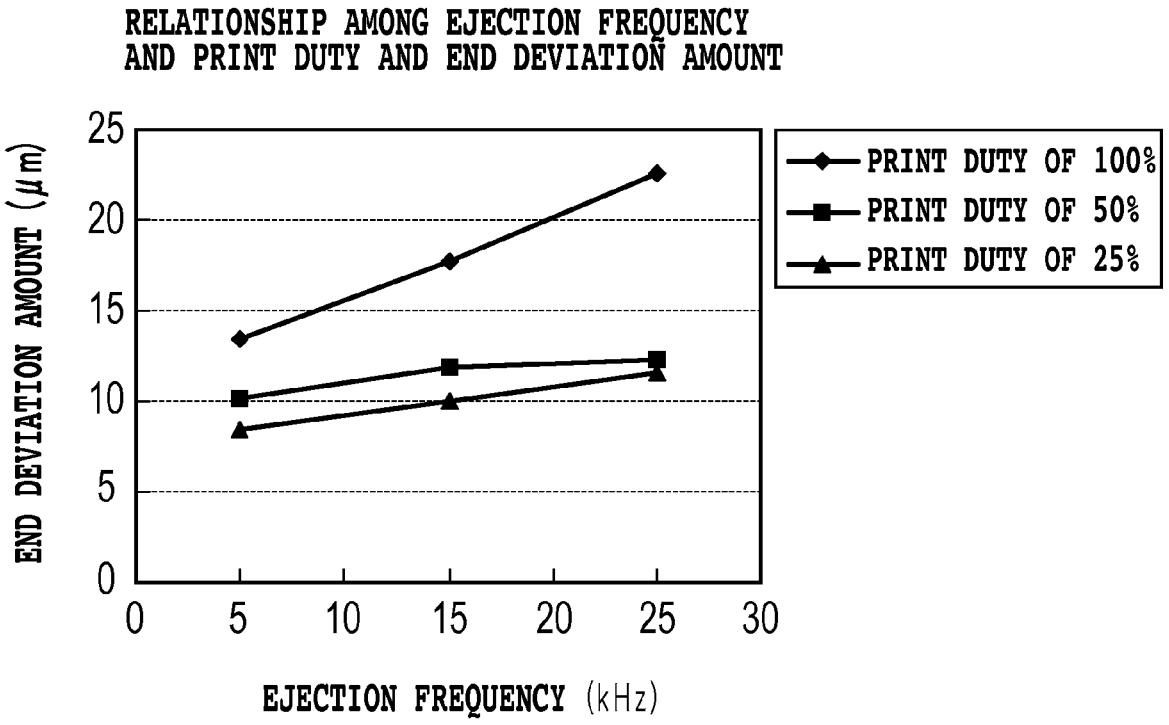
FIG. 8 is a graph showing the relationship among the driving (ejection) frequency of the head, the print duty and the amount of end deviation observed when printing is performed using yellow ink ejection port rows Y1 and Y2.

FIG. 8 is a graph showing the relationship among the driving (ejection) frequency of the head, print duty and the amount of end deviation observed when printing is performed using the yellow ink ejection port rows Y1 and Y2. The printing is performed under the following conditions. The amount of yellow ink ejected is 5 pl, the distance between the yellow ink ejection port rows is 0.25 mm, which is shortest among the three types of color ink, and the distance between the ink jet print head and the print medium (print paper) is 1.5 mm.

Furthermore, with respect to a 600-dpi lattice (pixels), a print duty of 100% means the dot arrangement shown in data 11 of FIG. 5. A print duty of 50% means the dot arrangement shown in data 10 of FIG. 5. A print duty of 25% means the dot arrangement shown in data 01 of FIG. 5. As shown in FIG. 8, the ejection frequency is set to 15 kHz. Then, when the print duty is 50% (2 dots/600 dpi), the amount of end deviation is about 12 μm. When the print duty is 100% (4 dots/600 dpi), the amount of end deviation is about 18 μm. In contrast to this, when the ejection frequency is dropped below 15 kHz, the amount of end deviation decreases. When the print duty is less than or equal to 50%, the amount of end deviation is less than or equal to about 10 μm. That is, in this case, it is seen that the amount of end deviation is relatively small.

Figures 9A, 9B, 9C:
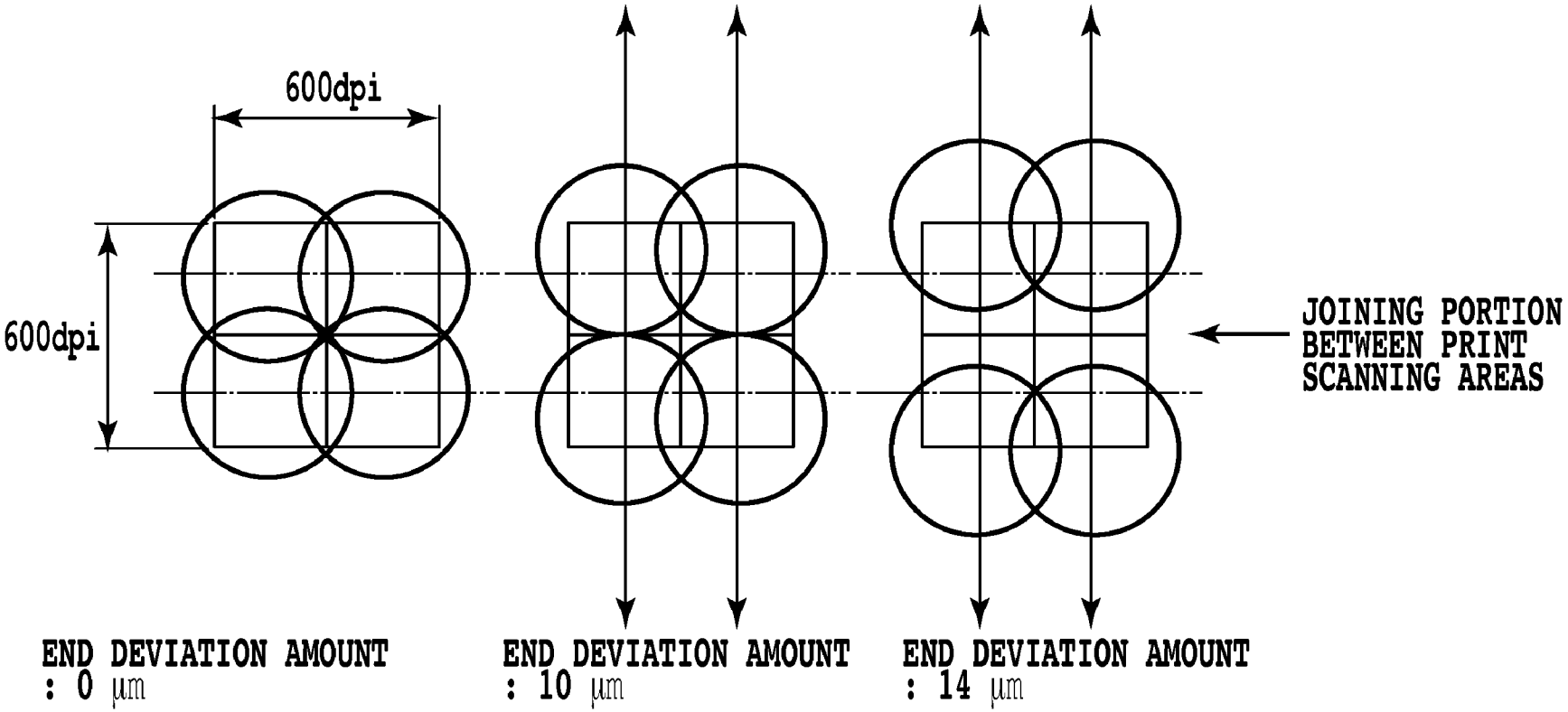

FIG. 9A to FIG. 9C show the relationship between the amount of end deviation and the dot arrangement. For example, when 5 pl of ink is ejected through the ejection port, the corresponding dot has a diameter of about 30 μm. At the joining portion between print areas, if the amount of end deviation in the ejection port row is zero, then as shown in FIG. 9A, the vertically adjacent dots in the figure overlap by about 5 μm. In contrast, if the amount of end deviation in the ejection port row is 10 μm, then as shown in FIG. 9B, the vertically adjacent dots do not substantially overlap but simply contact each other. Moreover, if the amount of end deviation in the ejection port row is more than 10 μm, the dots at the joining portion separate from each other, resulting in some areas to which no ink is applied. These areas appear to be white stripes, degrading image quality.

The print results in FIG. 8 are referred to again. When the print duty exceeds a certain value, the amount of end deviation in the yellow ink ejection port rows Y1 and Y2 exceeds 10 μm, which is a threshold of generating white stripes. This indicates the need for measures for preventing end deviation. As yellow ink has a high lightness and thus white stripes in an image by only yellow have a low visibility, the white stripes do not substantially affect the image. However, for the black ink ejection port rows Bk1 and Bk2, since black ink has a low lightness, white stripes in an image have a high visibility. Thus, in this case, the end deviation measures are more important.

Figure 4:
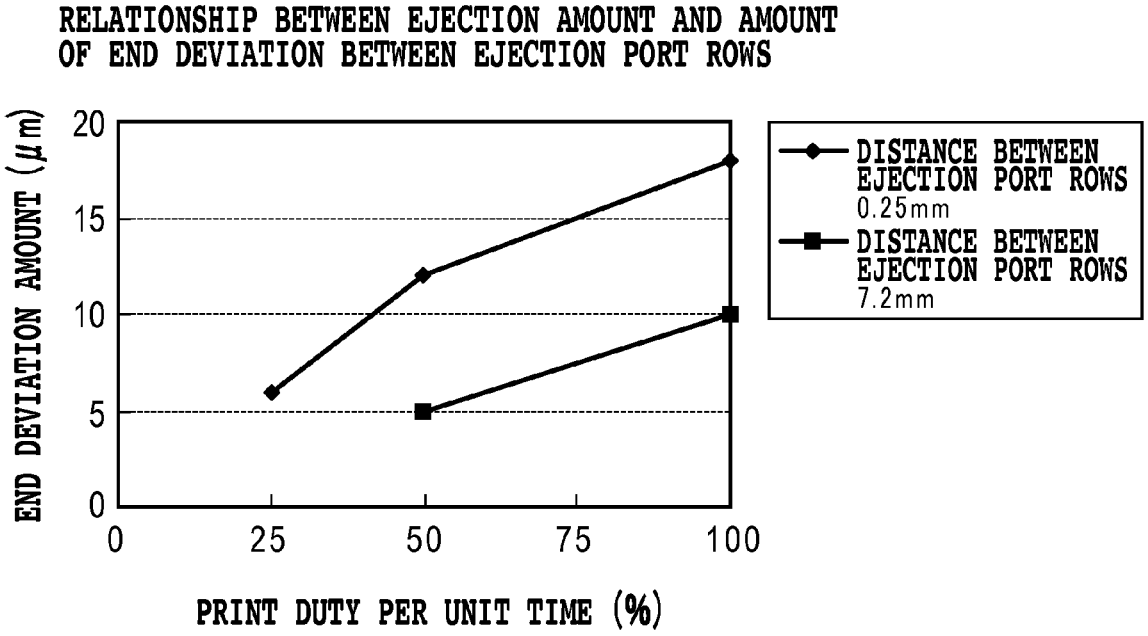
FIG. 4 is a graph showing the relationship among print duty per unit time, the distance between black ink ejection port rows and the amount of end deviation.

FIG. 4 shows the relationship among the print duty per unit time, the distance between black ink ejection port rows, and the amount of end deviation. A given amount of ink is ejected to such a 600-dpi lattice as shown in FIG. 5. In the case in which 5 pl of ink is ejected into the 600 dpi lattice for each of 4 dots, the print duty per unit time is defined as being 100% (data 11 in FIG. 5). In the case in which 10 pl of ink is ejected into the 600 dpi lattice for each of 2 dots, it is defined as being 50% (data 10 in FIG. 5). In the case in which 20 pl of ink is ejected into the 600 dpi lattice for one dot, it is defined to be 25% (data 01 in FIG. 5). As is apparent from the results in FIG. 4, a dot arrangement with larger droplets ejected at a lower density tends to reduce the amount of end deviation compared to a dot arrangement with smaller droplets ejected at a higher density. However, if black ink composed of a pigment is used to print characters, an excessively small ejection amount or an excessively low nozzle resolution may disadvantageously degrade the edges of black ink dots formed on plain paper (print paper). Thus, preferably, the ejection amount and the size of droplets are reduced and the resolution of the ejection ports is increased to the extent that the edges are prevented from being degraded. Furthermore, as seen in FIG. 4, if the distance between the black ink ejection port rows is long, 7.2 mm, then the amount of end deviation is drastically reduced by decreasing the print duty per unit time.

First Embodiment

Thus, in the ink jet print head according to the present invention, the ejection ports are arranged as shown in FIG. 2A based on the results shown in FIG. 4. Furthermore, the amount of black ink ejected is set to 10 pl, and the amount of color ink ejected is set to 5 pl. In the present embodiment, the plurality of ejection ports making up the corresponding ejection port rows Bk1 and Bk2 in the first and second black ink ejection chips 1200 and 1201 are staggered with respect to one another (staggered arrangement). Also, the plurality of ejection ports making up the ejection port rows C1 and C2 in the color ink ejection chip 1100 through which cyan ink is ejected are staggered with respect to one another. Similarly, the plurality of ejection ports making up the ejection port rows M1 and M2 though which magenta ink is ejected are staggered with respect to one another. The plurality of ejection ports making up the ejection port rows Y1 and Y2 though which yellow ink is ejected are also staggered with respect to one another. Thus, in the present embodiment, the nozzle resolution of the black ink ejection ports and the nozzle resolution of the color ink ejection ports are both 1,200 dpi.

In the present embodiment, as described above, the print duty per unit time can be reduced by setting the amount of black color ejected to be larger than that of color ink ejected. This reduces the impact of a self air flow. Moreover, self air flows generated near the black ink ejection port rows Bk1 and Bk2, respectively, are prevented from affecting each other by separately (distributively) arranging the first and second black ink ejection chips 1200 and 1201 on the respective sides of the color ink ejection chip 1100. Thus, the end deviation caused by the self air flow can be prevented, thus enabling white strips in printed images to be eliminated. The image quality is thus significantly improved. In the present embodiment, in the black ink ejection port rows Bk1 and Bk2 in the first and second black ink ejection chips 1200 and 1201, respectively, the plurality of ejection ports are arranged in a line on one side of each of the common liquid chambers 1006 and 1007. However, the present invention is not limited to this aspect. That is, a plurality of black ink ejection port rows may be formed provided that the ejection port rows are arranged on one side of each of the common liquid chambers 1006 and 1007. In this case, the adjacent ejection port rows are preferably staggered with respect to each other.

Second Embodiment

Figure 2B:
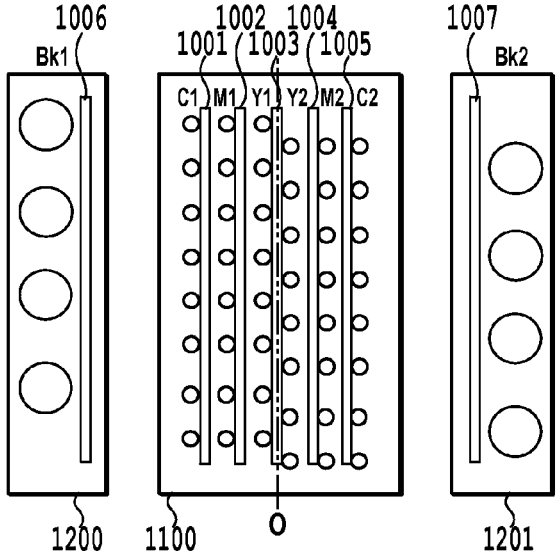

FIG. 2B shows a second embodiment of the ink jet print head according to the present invention. The present embodiment is the same as the first embodiment except for the amount of black ink and the nozzle resolution of the black ink ejection ports. That is, in the present embodiment, the amount of black ink ejected is set to 20 pl, and the amount of color ink ejected is set to 5 pl as is the case with the first embodiment. Furthermore, the nozzle resolution of the black ink ejection ports is 600 dpi, and the nozzle resolution of the color ink ejection ports is 1,200 dpi as is the case with the first embodiment.

Also in the present embodiment, the amount of black ink ejected is set to be larger than that of color ink ejected. Furthermore, the first and second black ink ejection chips 1200 and 1201 are separately arranged on the respective sides of the color ink ejection chip 1100. Thus, the present embodiment exerts the same effects as those of the first embodiment.

Third Embodiment

Figure 2C:
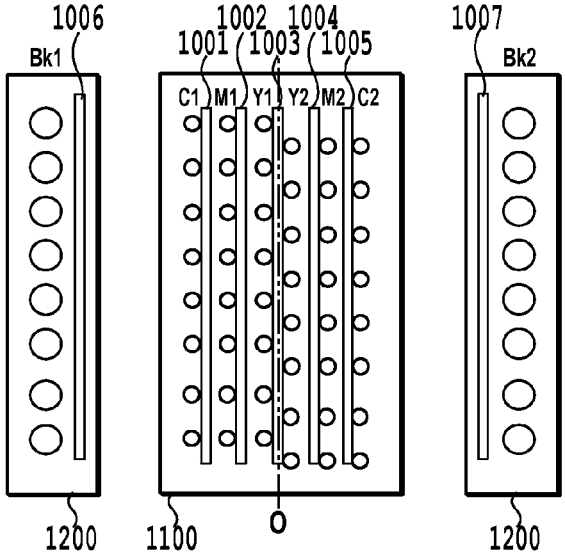

FIG. 2C shows a third embodiment of the ink jet print head according to the present invention. The present embodiment is the same as the first embodiment except that the black ink ejection port rows Bk1 and Bk2 in each of the first and second black ink ejection chips 1200 and 1201 in the above-described first embodiment are not staggered with respect to each other. That is, in the present embodiment, as is the case with the first embodiment, the amount of black ink ejected is set to 10 pl, and the amount of color ink ejected is set to 5 pl. Furthermore, the nozzle resolution of the black ink ejection ports is 600 dpi, and the nozzle resolution of the color ink ejection ports is 1,200 dpi as is the case with the first embodiment. Printing performed by the ink jet print head according to the present embodiment is expected to be as effective as that performed by the ink jet print heads according to the first and second embodiments.

Fourth Embodiment

FIG. 3A shows a fourth embodiment of the ink jet print head according to the present invention. The present embodiment is different from the above-described first embodiment in the configuration of the ejection port rows formed in the first and second black ink ejection chips 1200 and 1201. In the present embodiment, in each of the first and second black ink ejection chips 1200 and 1201, the two ejection port rows each including the plurality of ejection ports through which black ink is ejected are arranged on the respective sides of the common liquid chamber 1006 or 1007, respectively, so as to be staggered with respect to each other. That is, in the present embodiment, black ink is ejected through the four ejection port rows Bk11, Bk12, Bk21, and Bk22. The distance between the ejection port rows Bk11 and Bk21 and between the ejection port rows Bk12 and Bk22 is about 2.5 mm. As is the case with the above-described first embodiment, in the present embodiment, the amount of black ink ejected is set to 10 pl, and the amount of color ink ejected is set to 5 pl. Furthermore, the nozzle resolution of the black ink ejection ports and the nozzle resolution of the color ink ejection ports are both 1,200 dpi. The movement speed of the carriage is 25 inch/s (635 mm/s).

In the present embodiment, regardless of the print (image) duty, the combination of the ejection port rows Bk11 and Bk22 and the combination of the ejection port rows Bk12 and Bk21 both having a long inter-row distance are alternately selected to drive the ejection ports in each of the ejection port rows. Specifically, for example, it is assumed that consecutive dots are ejected into the 600-dpi lattice for the data 11 in FIG. 4. The first column is driven using the combination of the ejection port rows Bk11 and Bk22. Then, the second column that is out of alignment with the first column by 1,200 dpi is driven using the combination of the ejection port rows Bk12 and Bk21. Moreover, the third column that is out of alignment with the second column by 1,200 dpi is driven using the combination of the ejection port rows Bk11 and Bk22 again.

The order of the combinations of the rows driven is not limited to the above-described one. The combination of the ejection port rows Bk12 and Bk21 may be driven first, and then the combination of the ejection port rows Bk11 and Bk22 may be driven.

Also in the present embodiment, the print duty per unit time can be reduced by setting the amount of black ink ejected to be larger than that of color ink ejected. Thus, as is the case with the first embodiment, the impact of the self air flow is reduced. Moreover, as described above, the present embodiment enables the selective driving of one of the combinations of the ejection port rows with a long inter-row distance which are formed in the first and second black ink ejection chips 1200 and 1201 separately arranged on the respective sides of the color ink ejection chip 1100. This prevents the self air flows generated near the respective black ink ejection port rows from affecting each other. Thus, like the first embodiment, the present embodiment enables the end deviation possibly caused by the self air flow to be prevented, enabling printing free from white stripes. As a result, the image quality is drastically improved. In the present embodiment, a total of two ejection port rows are arranged on the respective sides of each of the common liquid chambers 1006 and 1007 so as to be staggered with respect to each other. However, the present invention is not limited to this aspect. More than two ejection port rows may be staggered with respect to each other.

Fifth Embodiment

Figure 3B:
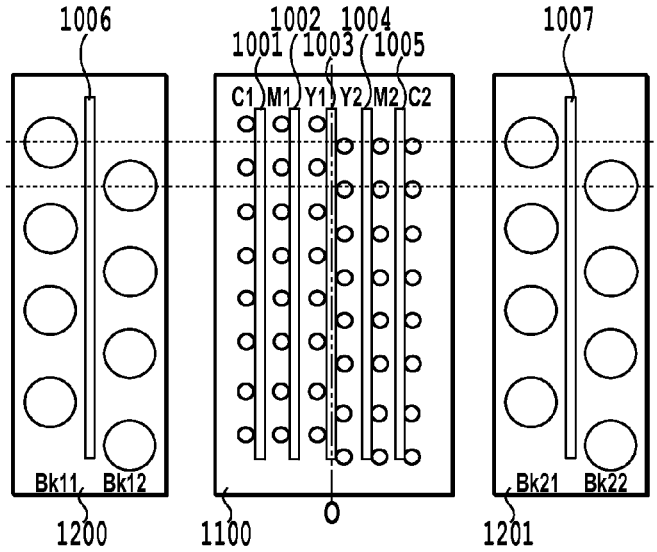

FIG. 3B shows a fifth embodiment of the ink jet print head according to the present invention. The present embodiment is the same as the fourth embodiment except for the ejection amount of black ink and the nozzle resolution of the black ink ejection ports. That is, in the present embodiment, the amount of black ink ejected is set to 20 pl, and the amount of color ink ejected is set to 5 pl as is the case with the fourth embodiment. Furthermore, the nozzle resolution of the black ink ejection ports is 600 dpi, and the nozzle resolution of the color ink ejection ports is 1,200 dpi as is the case with the fourth embodiment.

Also in the present embodiment, the ejection amount of black ink is set to be larger than that of color ink. Furthermore, the first and second black ink ejection chips 1200 and 1201 are separately arranged on the respective sides of the color ink ejection chip 1100. The present embodiment thus exerts effects similar to those of the above-described fourth embodiment.

Sixth Embodiment

Figure 3C:
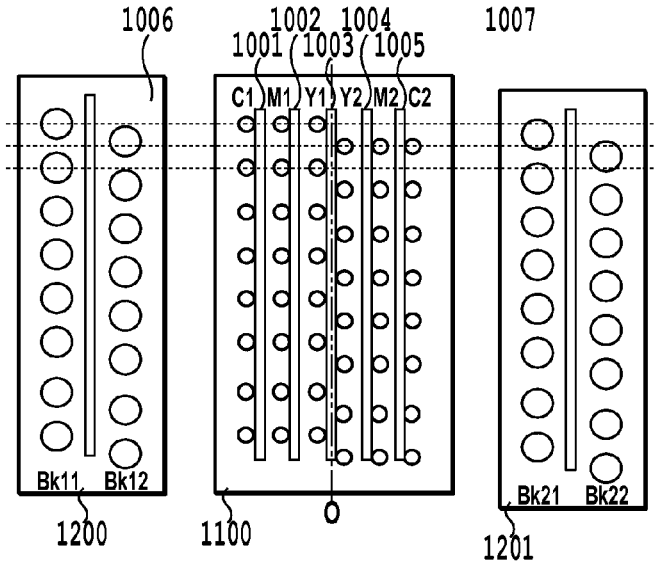

FIG. 3C shows a sixth embodiment of the ink jet print head according to the present invention. The present embodiment is different from the fourth embodiment in that the first and second black ink ejection chips 1200 and 1201 are out of alignment in the sub-scanning direction. That is, in the present embodiment, the first black ink ejection chip 1200 is located such that the first black ink ejection chip 1200 is out of alignment with the second black ink ejection chip 1201 by half (2,400 dpi) of the nozzle resolution of the black ink ejection ports, 1,200 dpi in a direction of the black ink ejection port row.

In the present embodiment, the black ink ejection ports, included in the four ejection port rows Bk11, Bk12, Bk21, and Bk22, have a nozzle resolution of 2,400 dpi. The color ink ejection ports have a nozzle resolution of 1,200 dpi. In the present embodiment, the carriage movement speed is 40 inch/s (1,016 mm/s) and is faster than in the fourth embodiment.

When the combination of the ejection port rows with a long inter-row distance is selected regardless of the print duty as is the case with the fourth embodiment and if the print duty is low, traces like wind ripples may remain on the media on which an image is being formed. The wind ripples result from that satellites of black ink slightly regularly are shaped by turbulence caused by movement of the carriage. Thus, the wind ripples are noticeable in areas with relatively low densities.

That is, when the distance between the ejection port rows used is long, satellites from the ejection port rows are caught in an unstable gas flow generated in the space present between the print medium (print paper) and the ejection port through which ink droplets are ejected. This may result in density unevenness. In contrast to this, when the distance between the ejection port rows used is short, the amount of satellites from the ejection port rows is the same as that obtained when the distance between the ejection port rows used is long. However, the short inter-row distance is expected to serve to reduce the rate at which the satellites are caught in the unstable gas flow. This is expected to prevent density unevenness from being generated.

Thus, in the present embodiment, the print duty is determined, and if the print duty is higher than a predetermined value, the combinations of the ejection port rows are alternately selected and driven as is the case with the fourth embodiment. That is, the combination of the ejection port rows Bk11 and Bk22 with a long inter-row distance and the combination of the ejection port rows Bk12 and Bk21 with a long inter-row distance are alternately selected and driven. On the other hand, if the print duty is lower than the predetermined value, the combination of the ejection port rows Bk11 and Bk12 with a short inter-row distance and the combination of the ejection port rows Bk21 and Bk22 with a short inter-row distance are alternately selected and driven. Specifically, for example, it is assumed that consecutive dots are shot into a 600-dpi lattice for data 11 in FIG. 5. The first column is driven using the combination of the ejection port rows Bk11 and Bk12. Then, the second column that is out of alignment with the first column by 1,200 dpi is driven using the combination of the ejection port rows Bk21 and Bk22. Moreover, the third column that is out of alignment with the second column by 1,200 dpi is driven using the combination of the ejection port rows Bk11 and Bk12. Also in this case, the order of the combinations of the ejection port rows driven is not limited to the above-described one. The ejection port rows may be alternately selected and driven by first driving the combination of the ejection port rows Bk21 and Bk22 and then driving the combination of the ejection port rows Bk11 and Bk12. In the present embodiment, the predetermined print duty is set to 50%. However, the print duty is not limited to 50% but is appropriately freely selectable.

In the present embodiment, if the print duty is low, the combination of the ejection port row with a short inter-row distance is selected. This prevents density unevenness like wind ripples from being generated, thus enabling proper images to be obtained.

The embodiments of the ink jet print head according to the present invention have been described. However, the present invention is not limited to these embodiments but may embrace any changes that are consistent with the technical concepts of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-321081, filed Dec. 17, 2008, which is hereby incorporated by reference herein in its entirety.

What is claimed is:

1. An ink jet print head comprising:

a first black ink ejection chip and a second black ink ejection chip each including a black ink ejection port row having a plurality of ejection ports through which black ink is ejected;

a color ink ejection chip including a plurality of color ink ejection port rows each having a plurality of ejection ports through which color ink is ejected; and a support member that supports the first black ink ejection chip, the second black ink ejection chip and the color ink ejection chip, wherein each of the plurality of ejection ports through which the black ink is ejected has a larger ejection amount than each of the plurality of ejection ports through which the color ink is ejected, and at least one black ink ejection port row is provided in each of the first and second black ink ejection chips, and the first and second black ink ejection chips are arranged on respective sides of the color ink ejection chip.

2. The ink jet print head according to claim 1, wherein, in each of the first and second black ink ejection chips, one ejection port row is arranged only on one side of a common liquid chamber through which ink is supplied to the black ink ejection ports.

3. The ink jet print head according to claim 2, wherein the one ejection port row provided in the first black ink ejection chip and the one ejection port row provided in the second black ink ejection chip are positioned symmetrically with respect to a center line of the color ink ejection chip, and the symmetrically positioned ejection port rows are staggered with respect to each other.

4. The ink jet print head according to claim 1, wherein, in each of the first and second black ink ejection chips, a plurality of ejection port rows are arranged only on one side of a common liquid chamber through which ink is supplied to the black ink ejection ports, and adjacent ejection port rows are staggered with respect to each other.

5. The ink jet print head according to claim 1, wherein, in each of the first and second black ink ejection chips, one ejection port row is located on each of opposite sides of a common liquid chamber through which ink is supplied to the black ink ejection ports, and the two ejection port rows arranged on the respective sides of the common liquid chamber are staggered with respect to each other.

6. The ink jet print head according to claim 5, wherein the first black ink ejection chip is out of alignment with the second black ink ejection chip by a pitch that is half of the nozzle resolution of the black ink ejection port rows in a direction of the black ink ejection port rows.

7. The ink jet print head according to claim 1, wherein, in each of the first and second black ink ejection chips, a plurality of ejection port rows are located on each of opposite sides of a common liquid chamber through which ink is supplied to the black ink ejection ports, the two ejection port rows arranged adjacent to and on respective sides of the common liquid chambers are staggered with respect to each other, and the two adjacent ejection port rows arranged on each of the opposite sides of each of the common liquid chambers are also staggered with respect to each other.

8. The ink jet print head according to claim 1, wherein each of the black ink ejection port rows and the color ink ejection port rows have the same nozzle resolution.

9. The ink jet print head according to claim 1, wherein each of the black ink ejection port rows has a lower nozzle resolution than that of the color ink ejection port rows.

10. The ink jet print head according to claim 1, wherein each of the black ink ejection port rows is longer than the color ink ejection port rows.

11. An ink jet printing method using an ink jet print head, the ink jet print head comprising a first black ink ejection chip and a second black ink ejection chip each including at least one black ink ejection port row having a plurality of ejection ports through which black ink is ejected, a color ink ejection chip including a plurality of color ink ejection port rows each having a plurality of ejection ports through which color ink is ejected, and a support member that supports the first black ink ejection chip, the second black ink ejection chip and the color ink ejection chip, wherein each of the plurality of ejection ports through which the black ink is ejected has a larger ejection amount than each of the plurality of ejection ports through which the color ink is ejected, and the first and second black ink ejection chips are arranged on respective sides of the color ink ejection chip, the method comprising:

selecting and driving one black ink ejection port row is selected from each of the first and second black ink ejection chips.

12. An ink jet printing method using an ink jet print head, the ink jet print head comprising a first black ink ejection chip and a second black ink ejection chip each including a plurality of black ink ejection port rows having a plurality of ejection ports through which black ink is ejected, and a color ink ejection chip including a plurality of color ink ejection port rows each having a plurality of ejection ports through which color ink is ejected, wherein each of the plurality of ejection ports through which the black ink is ejected has a larger ejection amount than each of the plurality of ejection ports through which the color ink is ejected, and the first and second black ink ejection chips are arranged on respective sides of the color ink ejection chip, the method comprising:

selecting a first combination of two black ink ejection port rows from the first and second black ink ejection chips, respectively, and a second combination of two black ink ejection port rows from the first and second black ink ejection chips, respectively, which is different from the first combination, and alternately driving the ejection port rows according to image data.

13. An ink jet printing method using an ink jet print head, the ink jet print head comprising a first black ink ejection chip and a second black ink ejection chip each including a plurality of black ink ejection port rows having a plurality of ejection ports through which black ink is ejected, and a color ink ejection chip including a plurality of color ink ejection port rows each having a plurality of ejection ports through which color ink is ejected, wherein each of the plurality of ejection ports through which the black ink is ejected has a larger ejection amount than each of the plurality of ejection ports through which the color ink is ejected, and the first and second black ink ejection chips are arranged on respective sides of the color ink ejection chip, the method comprising:

a step of determining a print duty of image data;

if the print duty is higher than a predetermined value, selecting and driving at least one black ink ejection port row from each of the first and second black ink ejection chips; and if the print duty is lower than the predetermined value, selecting and driving at least two black ink ejection port rows from the first or second black ink ejection chip.

14. The ink jet printing method according to claim 13, wherein if the print duty is low, a combination of at least two black ink ejection port rows selected from the first black ink ejection chip and a combination of at least two black ink ejection port rows selected from the second black ink ejection chip are alternately driven according to image data.

15. An ink jet printing apparatus comprising:

an ink jet print head, the ink jet print head comprising:

a first black ink ejection chip and a second black ink ejection chip each including at least one black ink ejection port row having a plurality of ejection ports through which black ink is ejected, and a color ink ejection chip including a plurality of color ink ejection port rows each having a plurality of ejection ports through which color ink is ejected, and a support member that supports the first black ink ejection chip, the second black ink ejection chip and the color ink ejection chip; and means for selecting one black ink ejection port row from each of the first and second black ink ejection chips, wherein each of the plurality of ejection ports through which the black ink is ejected has a larger ejection amount than each of the plurality of ejection ports through which the color ink is ejected, and the first and second black ink ejection chips are arranged on respective sides of the color ink ejection chip.

16. An ink jet printing apparatus comprising:

an ink jet print head, the ink jet print head comprising:

a first black ink ejection chip and a second black ink ejection chip each including a plurality of black ink ejection port rows having a plurality of ejection ports through which black ink is ejected, and a color ink ejection chip including a plurality of color ink ejection port rows each having a plurality of ejection ports through which color ink is ejected; and means for alternately selecting, according to image data, a first combination of two black ink ejection port rows selected from the first and second black ink ejection chips, respectively, and a second combination of two black ink ejection port rows selected from the first and second black ink ejection chips, respectively, which is different from the first combination, wherein each of the plurality of ejection ports through which the black ink is ejected has a larger ejection amount than each of the plurality of ejection ports through which the color ink is ejected, and the first and second black ink ejection chips are arranged on respective sides of the color ink ejection chip.

17. An ink jet printing apparatus comprising:

an ink jet print head, the ink jet print head comprising:

a first black ink ejection chip and a second black ink ejection chip each including a plurality of black ink ejection port rows having a plurality of ejection ports through which black ink is ejected, and a color ink ejection chip including a plurality of color ink ejection port rows each having a plurality of ejection ports through which color ink is ejected;

means for determining a print duty of image data; and means for selecting at least one black ink ejection port row from each of the first and second black ink ejection chips if the print duty is higher than a predetermined value, and selecting at least two black ink ejection port rows from the first or second black ink ejection chip if the print duty is lower than the predetermined value, wherein each of the plurality of ejection ports through which the black ink is ejected has a larger ejection amount than each of the plurality of ejection ports through which the color ink is ejected, and the first and second black ink ejection chips are arranged on respective sides of the color ink ejection chip.

18. An ink jet printing apparatus comprising:

an ink jet print head, the ink jet print head comprising:

a first black ink ejection chip and a second black ink ejection chip each including a plurality of black ink ejection port rows having a plurality of ejection ports through which black ink is ejected, and a color ink ejection chip including a plurality of color ink ejection port rows each having a plurality of ejection ports through which color ink is ejected;

means for determining a print duty of image data; and means for alternately selecting, according to the image data, a combination of at least two black ink ejection port rows from the first black ink ejection chip and a combination of at least two black ink ejection port rows from the second black ink ejection chip if the print duty is lower than a predetermined value, wherein each of the plurality of ejection ports through which the black ink is ejected has a larger ejection amount than each of the plurality of ejection ports through which the color ink is ejected, and the first and second black ink ejection chips are arranged on respective sides of the color ink ejection chip.

* * * * *